United States Patent [19]

Coratte et al.

[11] Patent Number: 4,562,716

[45] Date of Patent: Jan. 7, 1986

[54] WIRE COOLING SYSTEM FOR USE IN A WIRE DRAWING MACHINE

[75] Inventors: Jacques Coratte; Dominique Petkovic, both of Chelles, France

[73] Assignee: Office Technique des Trefiles, Chelles, France

[21] Appl. No.: 573,680

[22] Filed: Jan. 25, 1984

[30] Foreign Application Priority Data

Feb. 2, 1983 [FR] France ..... 83 01598

[51] Int. Cl.[4] ..... B21C 9/00; B21C 1/02

[52] U.S. Cl. ..... 72/286; 72/289

[58] Field of Search ..... 72/286, 289, 280; 242/78; 432/77, 85; 266/102, 259, 260; 34/110, 20

[56] References Cited

U.S. PATENT DOCUMENTS

| | | | |
|---|---|---|---|
| 2,868,359 | 1/1959 | Holbrook | 72/289 |
| 3,368,382 | 2/1968 | Fleshman | 72/286 |
| 4,214,470 | 7/1980 | Hurst | 72/286 |

FOREIGN PATENT DOCUMENTS

| | | | |
|---|---|---|---|
| 794316 | 4/1958 | United Kingdom | 72/286 |
| 445489 | 10/1974 | U.S.S.R. | 72/286 |

*Primary Examiner*—Daniel C. Crane

*Attorney, Agent, or Firm*—Wenderoth, Lind & Ponack

[57] ABSTRACT

A wire cooling system for use in a wire drawing machine includes a capstan around the periphery of which is wound the wire to be drawn, thereby forming a jacket. A plurality of ports are formed in the capstan and open onto the periphery thereof. Cooling liquid is supplied to a first port and thereby passes through a space of the periphery of the capstan and the turns of the wire forming the jacket, thus cooling the wire. Compressed gas is supplied to a second port, thereby draining and recovering the cooling liquid. Compressed gas is supplied to a third port spaced axially of the first port, thereby controlling the circulation of the cooling liquid through the space.

3 Claims, 2 Drawing Figures

WIRE COOLING SYSTEM FOR USE IN A WIRE DRAWING MACHINE

BACKGROUND OF THE INVENTION

The present invention relates to a wire cooling system for use in a wire drawing machine of the type wherein a wire is pulled through a die and thereby drawn and sized, i.e. the cross section of the wire is reduced by such drawing.

As in any mechanical deformation operation, the reduction of the cross section of a metal wire by drawing, i.e. by pulling a wire through a die by means of a winding capstan, generates heat which results in increasing the temperature of the wire being drawn and of the tools in contact therewith. Such increase of temperature changes the mechanical characteristics of the wire. Such change is all the more detrimental the higher is the carbon content of the wire, for example with a steel wire, and such change produces aging phenomena well known in the art. This particularly is true of dry-type drawing machines where the lubricant used to facilitate the drawing operation is a dry powdery product with no cooling function whatsoever.

To limit the heating of the wire and to maintain the temperature thereof within metallurgically acceptable limits, presently employed drawing machines are equipped with wire cooling systems which roughly can be divided into two categories, namely indirect cooling systems and direct cooling systems.

Indirect cooling is achieved by means of employing a cooling liquid to cool the tools that come into contact with the wire, i.e. the die and the capstan. Since the contact time of a given wire section with the die is extremely short, this cooling is very limited. By contrast, the capstan has in contact therewith a large number of turns of the wire, thereby increasing the surface of contact between the hot wire and the cooled capstan. Accordingly, this cooling is more effective, but still is limited by fundamental heat exchange principles on the one hand, and by the purely linear contact between the round wire and the cylindrical periphery of the capstan on the other hand.

Direct cooling can be employed alone or in combination with indirect cooling and generally is of two types, i.e. air-type cooling and liquid-type cooling.

In air-type cooling, air is blown around the capstan and creates an ascending air jacket to cool the wire turns accumulated on the periphery of the capstan. This process frequently is used together with internal cooling of the capstan by means of a liquid as described above. It should be noted that the smaller the diameter of the wire, the greater is the effectiveness of air-type cooling. Limitations of this arrangement however are obvious because air has a low specific heat. Further disadvantages of this arrangement are the resultant noise and ecologically detrimental stirring or blowing of soaps and residues that always are present in a wire drawing machine.

Several types of liquid-type cooling systems are known and involve spraying the wire during its passage between the delivery side of the die and the point of contact with the capstan. These systems have proved to be ineffective on high speed drawing machines because, in view of the limited space available, the time of contact of the cooling liquid with the wire ranges from only a few tenths of a second to a few hundredths of a second. Furthermore, upon the occurrence of a wire break, the cooling liquid may well pass through the die and mix with the drawing soap upstream of the die. It should be noted that this type of system usually requires substantially longer wire threading points and thus makes, the stringing of the machine more difficult and delicate.

In another known liquid-type cooling system, cooling liquid from an external source is sprayed directly onto the wire turns that have accumulated on the capstan, thereby subjecting the wire to cooling for a longer period of time. Such a system would seem generally to be more effective, but in practice has been found to be unacceptable due to dripping of the cooling liquid, centrifugation of the cooling liquid, and the resultant misty or moist atmosphere formed around the machine.

Since the production of a wire drawing machine is dependent upon its speed, wire manufacturers have been searching for increasingly fast machines. However, since the degree of heating of the wire also is directly dependent upon speed, one is presented with a conflict that is difficult to overcome.

SUMMARY OF THE INVENTION

With the above discussion in mind, it is the object of the present invention to provide a wire cooling system of higher efficiency than presently known systems and which overcomes the above and other disadvantages of known systems.

This object is achieved in accordance with the present invention by the provision of a plurality of ports formed in the capstan and opening onto the periphery thereof. At least one first such port is supplied with a cooling liquid which thereby is passed through a space between the periphery of the capstan and the turns of the wire which form a jacket therearound, thereby cooling the wire. Compressed gas is supplied to at least one second of the ports and operates to drain and recover the cooling liquid from the space between the capstan periphery and the wire jacket. Compressed gas also is supplied to at least one third such port spaced axially of the first port in the direction of movement of the wire over the periphery of the capstan, and thereby operates to control the circulation of the cooling liquid through the space.

The system of the present invention can be employed alone or in addition to a conventional die cooling device should such be necessary for the protection of the die. The system of the present invention is adaptable to a drawing machine of conventional design, either of the single hole type of or the multiple hole type and involves only limited modifications of conventional capstans employed in wire drawing machines.

BRIEF DESCRIPTION OF THE DRAWINGS

Other objects, features and advantages of the invention will be apparent from the following detailed description of a preferred embodiment thereof, with reference to the accompanying drawings, wherein.

DETAILED DESCRIPTION OF THE INVENTION

Figure 1:
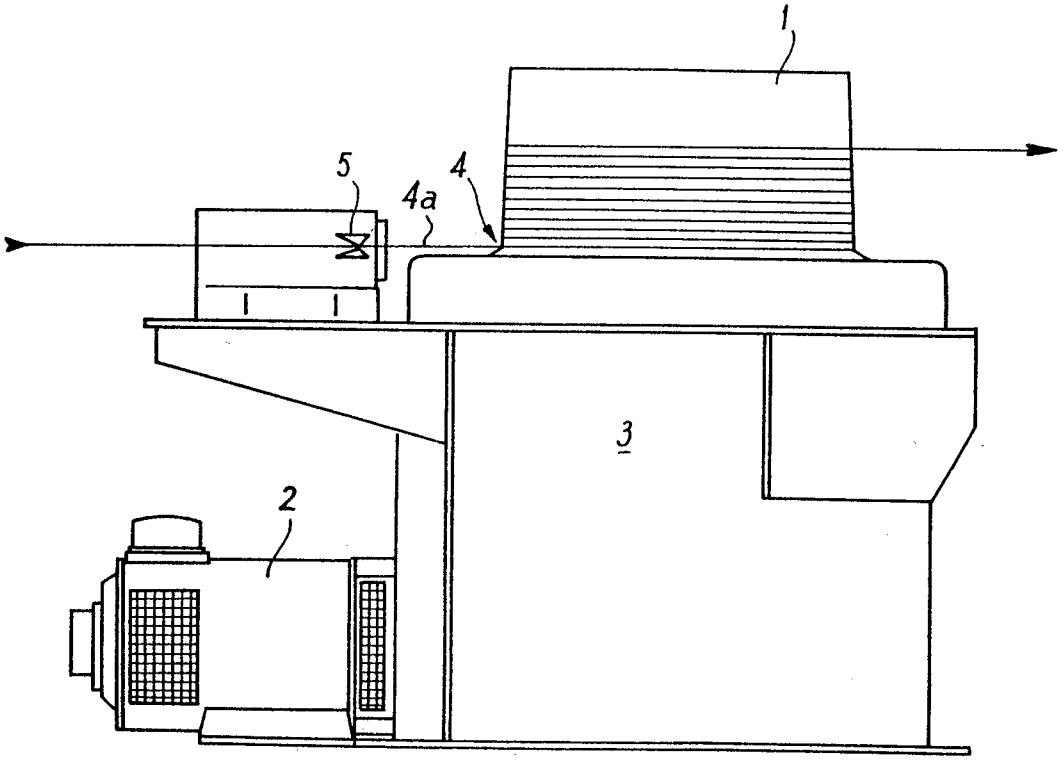
FIG. 1 is a schematic elevational view of a wire drawing machine having a capstan provided with the system of the present invention.
Figure 2:
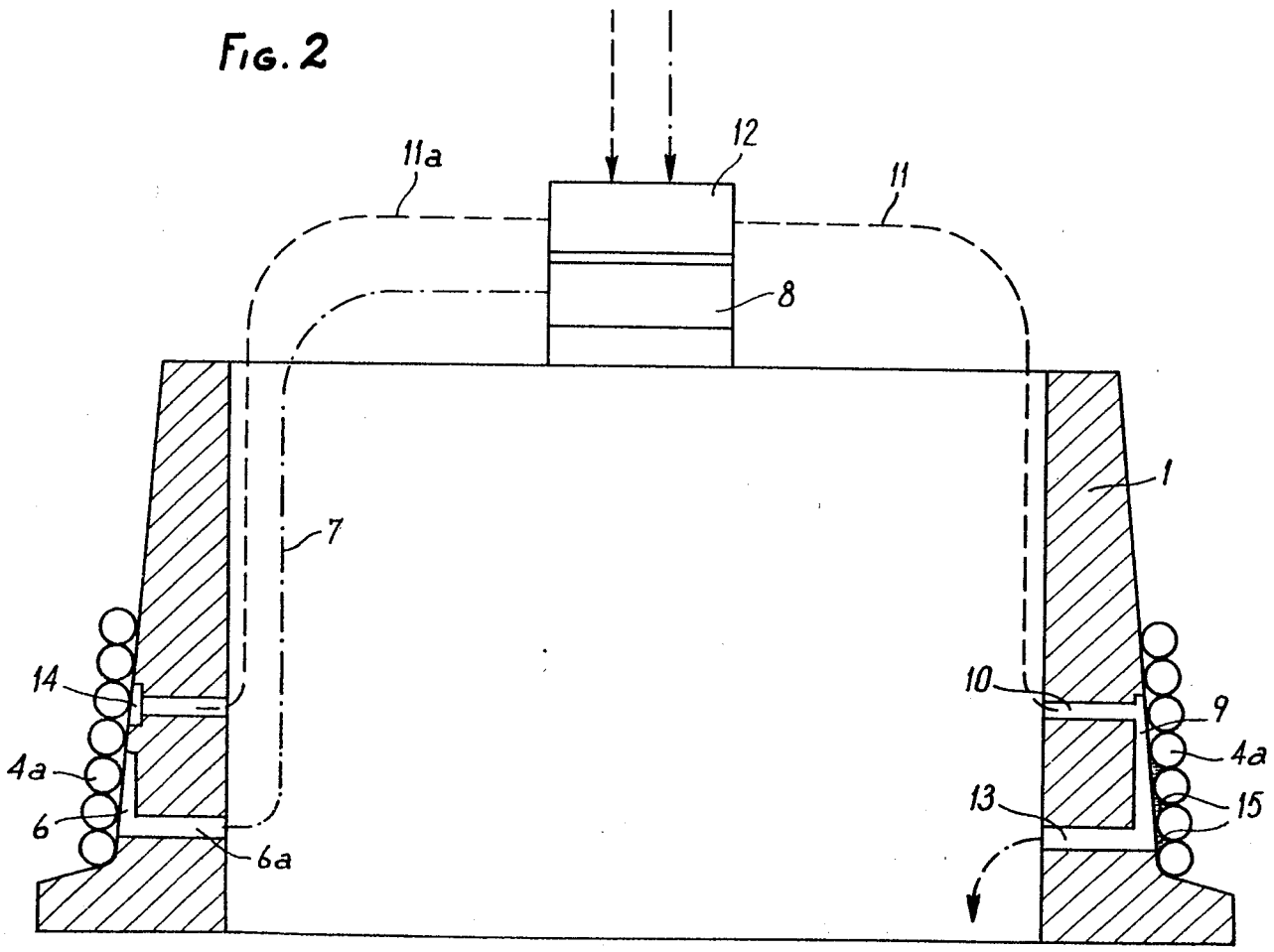
FIG. 2 is an enlarged sectional view taken along an axial plane through the capstan.

FIG. 1 illustrates a wire drawing machine including a capstan 1 in the shape of a cylindrical body rotated about a vertical axis by means of a motor 2 and a transmission 3. A wire 4*a* passes through a die 5 positioned upstream of the capstan and is brought onto the periphery of the capstan at a lower portion 4 thereof. The wire is wound around the periphery of the capstan for a plurality of turns, for example by the operator during the stringing of the machine, in order to obtain the necessary capstan effect needed for drawing the wire and to cover the cooling area of the capstan, to be discussed in more detail below. As the wiring drawing operation proceeds, the wire turns move upwardly along the periphery of the capstan prior to being drawn off therefrom at an upper portion to be passed to a wire drawing block positioned downstream of the capstan in the case of multiple drawing machines or to wire take-up machines in the case of the last block of a multiple drawing machine or in the case of single-block drawing machines.

In accordance with the present invention, a plurality of ports or grooves are formed in the capstan and open onto the external periphery thereof. Specifically, a number of different functioning ports are provided.

Thus, ports or axial grooves 6 serve to supply a cooling liquid to the wire turns 4*a* which are wound on the capstan periphery to form a jacket therearound. More specifically, openings 6*a* extend through the capstan from the interior thereof to the grooves 6. Conduits 7 are connected to openings 6*a* for supplying the cooling liquid, for example water, from a rotary seal 8 which is connected to an external cooling liquid supply. To upper ends of ports or axial grooves 9 is supplied compressed gas, for example compressed air, via openings 10 and conduits 11 which are connected with another rotary seal 12. The lower portions of ports or grooves 9 are connected to openings 13 passing through the capstan wall and may be connected to a conduit or drain (not shown) for recovering and draining the cooling liquid. Ports or axial grooves 14 are positioned axially above first ports or axial grooves 6 and are supplied with compressed gas via conduits 11*a* and rotary seal 12 in a manner similar to the manner of supply by means of conduits 11 and openings 10 to ports or grooves 9. Rotary seals 8 and 12 may be any conventional known such structure as would be understood by one skilled in the art, and also may be combined into a unitary double liquid-air seal.

Only one of each of ports 6, 9 and 14, as well as their associated openings and conduits, have been illustrated in the drawings. It is to be understood however that it is contemplated as being within the scope of the present invention to provide a plurality of any or all of such ports and associated openings and conduits. One of ordinary skill in the art would understand, for a given installation, how to determine the number and sizes of such ports to achieve a desired degree of cooling.

As a result of these structural features of the present invention, the wire turns 4*a*, which are in intimate contact with each other and with the capstan periphery due to the drawing force, form a jacket around the capstan periphery. The cooling liquid supplied by grooves 6 enter the curvilinear triangular areas 15 formed between the capstan periphery and adjacent wire turns. These areas form a continuous space in the form of a helix or Archimedes screw. The liquid supplied by grooves 6 thus moves around the capstan periphery and upwardly toward the upper layers of the wire. This rising of the cooling liquid is limited by the back pressure of the compressed gas supplied from ports 14. The cooling liquid thus is forced to travel generally along planes that are substantially perpendicular to the axis of the capstan until the cooling liquid is returned through ports or grooves 9 under gravity and also under the action of compressed gas injected through openings 10. The cooling liquid then is drained through openings 13.

In a contemplated modification of the present invention, openings 10 and 13 and the openings of ports 14 may be connected through conduits 11, 11*a* and rotary seal 12 to a suction system (not shown).

From the foregoing, it will be apparent that the system of the present invention is a dual or mixed cooling system achieving both direct and indirect cooling of the wire. Thus, the wire is subjected directly to the cooling liquid and thereby is directly cooled. On the other hand, the capstan is cooled internally by the same cooling liquid, thus achieving indirect cooling of the wire. The effectiveness of the system is reinforced by the action of the compressed air which not only dries the wire but also assists in the passage of the cooling liquid along the wire turns, and facilitates the recovery and withdrawal of the liquid.

In the event that it becomes necessary to improve the drying of the wire, the system of the invention may be supplemented with a suction chamber through which the wire passes before entering a downstream soap box and drawing die or block.

As will be apparent from the above, the system of the present invention is more effective than known cooling systems and overcomes the disadvantages of such known systems.

Although the present invention has been described and illustrated with respect to preferred features thereof, it is to be understood that various modifications may be made to the specifically described and illustrated arrangement without departing from the scope of the present invention.

We claim:

1. A wire cooling system for use in a wire drawing machine of the type wherein a wire is pulled through a die, said system comprising:

a wire pulling capstan mounted for rotation about a vertical axis, said capstan having an outer periphery, with a wire to be drawn brought onto said periphery at a lower portion thereof and wound therearound upwardly in a helical pattern to form a wire jacket, thereby defining between said periphery and said jacket a space in the form of a continuous helical chamber;

means for cooling said wire jacket, said cooling means comprising at least one first port formed in said capstan and opening onto said periphery adjacent said lower portion thereof, and means for supplying a cooling liquid to said at least one first port and thereby passing said cooling liquid into and through said helical chamber in an upward helical direction;

means for draining downwardly and recovering said cooling liquid from said helical chamber, said draining and recovering means comprising at least one second port formed in said capstan and opening onto said periphery thereof, and means for supplying compressed gas to said at least one second port;

means for limiting the upward helical movement of said cooling liquid in said helical chamber, said limiting means comprising at least one third port formed in said capstan and opening onto said periphery thereof at a location spaced axially above said at least one first port, and means for supplying compressed gas to said at least one third port; and said means for supplying compressed gas to said second and third ports also operating as means for drying said wire.

2. A system as claimed in claim 1, wherein said ports comprise axially extending grooves formed in said periphery.

3. A system as claimed in claim 2, wherein said means for supplying compressed gas to said second port introduces said compressed gas to the upper end of said axial groove thereof, and further comprising a drain connected to the lower end of said groove thereof.

* * * * *